US007658209B2

(12) United States Patent
Debaes

(10) Patent No.: US 7,658,209 B2
(45) Date of Patent: Feb. 9, 2010

(54) DEVICE FOR ACTUATING BINDING AND TENSION WARP YARNS AND PILE WEAVING MACHINE PROVIDED WITH SUCH A DEVICE

(75) Inventor: Johny Debaes, Moorslede (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 11/339,855

(22) Filed: Jan. 25, 2006

(65) Prior Publication Data

US 2006/0162801 A1 Jul. 27, 2006

(30) Foreign Application Priority Data

Jan. 25, 2005 (BE) ..... 2005/0046

(51) Int. Cl.
*D03D 39/12* (2006.01)
*D03D 39/00* (2006.01)
*D03D 39/16* (2006.01)

(52) U.S. Cl. ..... 139/21; 139/37; 139/55.1; 139/58; 139/59; 139/79

(58) Field of Classification Search ..... 139/21, 139/37, 55.1, 58, 59
See application file for complete search history.

(56) References Cited

U.S. PATENT DOCUMENTS 4,122,871 A * 10/1978 McGinley ..... 139/460
4,182,380 A * 1/1980 Palau ..... 139/68
4,739,804 A * 4/1988 Shaw ..... 139/436
6,186,186 B1 2/2001 Debaes et al.
6,336,475 B2 * 1/2002 Dewispelaere et al. ..... 139/391
2001/0023157 A1 * 9/2001 Sheppard, Jr. ..... 442/203
2002/0011169 A1 * 1/2002 Sheppard, Jr. ..... 101/484
2004/0040611 A1 * 3/2004 Griffith ..... 139/11
2004/0216797 A1 * 11/2004 Porter ..... 139/85
2006/0162801 A1 * 7/2006 Debaes ..... 139/55.1

FOREIGN PATENT DOCUMENTS

DE 4221376 1/1994
EP 0848097 6/1998

OTHER PUBLICATIONS en.wikipedia.org/wiki/Jacquard_weaving; entire document.*

* cited by examiner

*Primary Examiner*—Bobby H Muromoto, Jr.
(74) *Attorney, Agent, or Firm*—James Creighton Wray; Meera P. Narasimhan

(57) ABSTRACT

A device for actuating binding and tension warp yarns, with at least one first shed forming device for actuating the tension warp yarns, and at least one second shed forming device for actuating the binding warp yarns. The first or the second shed forming devices are provided with a central drive to actuate the respective yarns. A pile weaving machine is provided with such a device.

26 Claims, 4 Drawing Sheets

DEVICE FOR ACTUATING BINDING AND TENSION WARP YARNS AND PILE WEAVING MACHINE PROVIDED WITH SUCH A DEVICE

This application claims the benefit of Belgian Application No. 2005/0046 filed Jan. 25, 2005, which is hereby incorporated by reference in its entirety.

BACKGROUND OF INVENTION

On the one hand, the invention relates to a device for actuating binding and tension warp yarns, comprising at least one first shed forming device for actuating the tension warp yarns, and at least one second shed forming device for actuating the binding warp yarns. On the other hand, the invention relates to a pile weaving machine, preferably a face-to-face weaving machine, provided with such a device.

On a pile weaving machine, one or several backing fabrics are woven, in which pile warp yarns are used and interlaced in order to form pile loops or a cut pile.

When the pile weaving machine is a face-to-face weaving machine, an upper and a lower backing fabric are woven simultaneously between which pile warp yarns may extend connecting both fabrics to one another, and in which, after having cut the said pile warp yarns, two pile fabrics are obtained, i.e. a lower fabric and an upper fabric. In each of the two backing fabrics, pile warp yarns may be interlaced separately, either directly around the wefts, or by means of spacers in order to obtain pile loops. Thus, cut pile fabrics, as well as loop fabrics, false loop fabrics or combinations of these fabrics may be woven. In both fabrics binding and tension warp yarns, of which yarns are usually found in each warp system, are forming the backing fabric, together with the weft yarns.

In the (backing) fabric, the binding and tension warp yarns each have a different function.

The binding warp yarns are having the following functions:

Tying up the weft yarns in the backing fabrics, the binding warp yarns enveloping the wefts which have been inserted into the fabric and regularly crossing those wefts in order alternately to extend above and below the wefts in this manner. The path of the binding warp yarns and the way they are crossing will determine how many shots (how many wefts) per unit of length will be inserted into the fabric, the basic rule being that the more crossings are effected by the binding warp yarns, the less tight the fabric will be, because the binding warp yarns crossing will reduce the place of the weft yarns in order to beat them up tightly.

Supporting the rapiers. In rapier weaving machines, and therefore also in a face-to-face weaving machines with one or several rapier systems, the carrier and the gripper rapier, in their course towards one another in order to take over the weft yarn, have to be supported. To that effect, a yarn layer is formed in the shed right below the path of the rapier. To this effect, the binding warp yarns may be used.

In a three rapier weaving machine, the binding warp yarns have to be positioned in three positions.

in the upper fabric above the upper rapier, between the upper rapier and the middlemost rapier, between the middlemost rapier and the lower rapier;

in the lower fabric below the lower rapier, between the lower rapier and the middlemost rapier, between the middlemost rapier and the upper rapier;

These three positions are required both for tying up also the middlemost weft and to avoid that the upper and the lower fabric will get interwoven. The third position is also of importance in order to enable the rapiers to perform their supporting function.

The tension warp yarns have the following functions:

to separate the wefts inserted into two layers in the backing fabric (wefts situated above the tension warp yarn and wefts situated below the tension warp yarn). This effect is realized by putting a higher strain on the tension warp yarns than on the binding warp yarns.

preventing the pile warp yarn from crossing or spreading those crossings as much as possible during the period the shed is being formed (=motion of all warp yarns in order to take up their positions to be able to realize the fabric desired with the weave and pattern as requested at the next weft insertion). The tension warp yarn is under a higher strain than the binding warp yarn, and therefore it will usually also have a larger cross-section. When the warp yarns are positioning themselves during the period the shed is being formed, yarns may get crossed. With such a crossing, a considerable number of warp yarns are situated next to one another, what, with large numbers of rather thicker warp yarns (for instance, pile warp yarns and tension warp yarns) may give cause to high friction, yarn breakage and of yarns getting entangled. Therefore, the various packages of warp yarns (pile, tension and binding warp yarns) are kept apart as much as possible and the number of warp yarns crossing simultaneously, is kept as low as possible and the warp yarns with the greatest diameter will be spared as much as possible in doing so;

This problem may be solved by:

causing the motion of the backing warp yarns to pass off out of phase with respect to the motion of the pile warp yarns;

causing certain warp yarns, for instance the tension warp yarns to move further on than other warp yarns, for instance the pile warp yarns, in order to avoid certain crossings entirely in this manner;

splitting up the weaving frames, for instance those of the tension warp yarns, causing a necessary crossing, for instance, with the pile warp yarns, to be divided between two groups, because of which a crossing may be realized at different times, by means of a different law of motion.

Pulling open the face-to-face fabric within the height of the jaw, thus maintaining the pile height at a constant value. This function is mainly of importance when weaving with three rapier weaving, because with this method the use of lancets as spacers between the upper and the lower fabric is not possible. In this case, the tension warp yarn is used in order to take over this function. Also with double rapier weaving, it may be necessary to decide to weave without using lancets because of economic or technical reasons and in this case also, the tension warp yarns should ensure the distance between the upper and lower fabric by means of their tension.

Supporting the rapiers. Preferably, the tension warp yarns are used to that effect, because the higher tension of the yarns will provide a better guiding of the rapiers along the supporting layer. Only, the tension warp yarns are not always available for this supporting function, because of their other functions, among which avoiding and spreading crossings with the pile warp yarns or their positioning above the rapier. It may also be advantageous to split the tension warp yarns into a portion having a supporting function for the rapiers and a portion positioning themselves further away from the rapiers, out of reach of the pile warp yarns.

When developing and producing new textures, a strong emphasis is lying on fabrics with a higher density and a better quality. The methods here applied are expected to enable to shift from one fabric to another in a flexible manner and with minimal transformations of the machine. These minimal transformations have to be as controllable as possible from the controls of the machine without any mechanical means and mechanical conversion.

In order to produce fabrics with a higher density, the density has to be increased, both in the weft direction, i.e. more warp yarns per unit of length, and in the warp direction, i.e. more wefts per unit of length. A higher density in the weft direction will have the effect that the mass of warp yarns causing crossings of warp yarns will become tighter, and therefore crossings should be more avoided or should be more spread out. A higher density in the warp direction has the effect that it is necessary to deal with binding warp yarns in a creative way in order to minimize the number of crossings and yet to obtain a good or even better quality of the fabric. The quality of the fabric is namely determined by the purity of the back, pile strength, whether a pile is standing upright or not, if not any other effect is purposely aimed at, and the form retention of a fabric in which also the weft yarns should be well stuck.

The flexibility in the methods applied mainly consists in actuating, from the control of the machine, changes in the nature of the pile forming, but also in carrying out the backing weave, in other words in the manner in which the binding and tension warp yarns are moving through several cycles. These actions taken on the machine control may occur both by means of a manual interaction of the operator of the machine and by completing a programme with which several fabrics with a variety of textures may be woven successively. Realising these aims will be strongly determined to the extent in which the binding and tension warp yarns of the backing fabric may be flexibly actuated.

To actuate the binding and tension warp yarns of the backing fabrics during pile weaving, it has been customary for quite some time, to use cam disc machines, one drive driving a series of cams, each cam driving a weaving frame, which is positioning a set of warp yarns in order to take up their position in the geometry of the shed. This solution has the disadvantage that, on the one hand the number of weaving fames being driven in this manner, will be limited to eight and that a change of the texture for the backing weave usually requires the cams to be exchanged. Optimization of crossings and geometry of the shed will occur by exchanging the cams or by adjusting the cams on the central drive shaft. Both changes are rather time-consuming and will prevent a flexible shifting from one texture to another.

With the changeover to electronic dobby devices, where the required position may be passed and selected at each shot, a higher flexibility has been obtained in the field of textures. However, with respect to an optimal forming of the shed, there is not a single possibility left to spread the motional evolution of warp yarns driven by the same dobby device. Moreover, a dobby device is able to absorb only more limited forces than the cam disc machines. Hence, that dobby devices, as far as pile weaving is concerned, were initially used mainly for velvet weaving, and only later on they were introduced for carpet weaving. Besides the disadvantages in order to obtain an optimal shed forming, this method to form the shed is indeed enabling a larger variety of weaves. The effect of strong forces which has to be controlled with large weaving widths and great strains in the warp yarns is imposing limits. The heavy and expensive dobby systems used to that effect with carpet weaving, are further limited to a maximum of twelve weaving frames. Moreover, no applications are known where this kind of shed forming device is used for weaving backing warp yarns on weaving machines provided with three rapiers, simultaneously inserting a weft. In this case a dobby system would have to position each binding warp yarn in three positions. Thinking in terms of the devices known, such a construction is in principle easy to produce. However, because of this, the number of weaving frames available for the backing weave is still further restricted, as per weaving frame, two selection elements are required in order to realize the three positions.

In EP 848 097 a solution is described where weaving frames are provided for driving the tension and binding warp yarns, which each are driven by a separate motor, the driving chain between the motor and the weaving frame is passing a first lever driving the weaving frame through an intermediate drive. The purpose of the invention being to obtain an increase of the flexibility, to optimize the geometry of the shed and to improve the laws of motion. However, providing one motor for each weaving frame as a solution is also an expensive solution. Furthermore, the tension and binding warp yarns each will still be driven by a motor which will indeed be able to realize a different law of motion, but which, in all cases, is driving a weaving frame. The number of weaving frames, that may be installed one after the other will, for practical reasons, still be limited to twelve, because in case more weaving frames will be used, the extreme positions into which should be taken the backing warp yarns, the farthest from the weaver, will be situated too far away from one another to be able to realize shed forming means. This problem will claim the attention even more with face-to-face weaving machines with three rapiers, where the binding warp yarns should be able to move from a position situated above one rapier into a position situated below the lower rapier and to that effect should be able to perform a greater motion than with a weaving machine where two rapiers are simultaneously inserting one weft into the backing fabrics.

In EP 1 180 556 methods are represented and described for manufacturing fabrics having a high density and a high quality, however, how the tension and binding warp yarns are driven in order to realize these textures has not been indicated.

In the state-of-the-art described in U.S. Pat. No. 6,186,186 it is suggested that up to three Jacquard devices are used on one face-to-face weaving machine for weaving face-to-face pile fabrics, two Jacquard devices of which are used for positioning backing warp yarns in the shed. The splitting up here performed, however, is not the splitting up between binding and tension warp yarns in order to be able to make a better use of the various functions of the types of yarn, but it is a splitting up between a two-position Jacquard machine for the backing warp yarns of the upper fabric and a two-position Jacquard machine for the backing warp yarns of the lower fabric, in order to realize a backing effect in both fabrics between warp yarns and weft yarns in the areas where now cut pile occurs.

SUMMARY OF INVENTION

On the one hand, the purpose of the invention is to provide a device for actuating binding and tension warp yarns in accordance with the preamble of the first claim, wherein in a flexible manner, textures may be woven for fabrics with a high density, a high quality, having a large variety of textures and at less cost than when using devices according to the state-of-the-art.

The purpose of the invention is on the one hand attained by providing a device for actuating binding and tension warp yarns, comprising at least one first shed forming device for actuating the tension warp yarns, and at least one second shed forming device for actuating the binding warp yarns, the first or the second said shed forming device being provided with a central drive to actuate the respective yarns.

In this manner, the functions of the tension and binding warp yarns mentioned above, which are very different from one another, may be optimally utilized. Moreover, this solution will offer the opportunity to realize a larger variety of textures. At the same time, splitting up the shed forming devices for the tension and the binding warp yarns will enable to find better solutions to anticipate the continuous need to realize tighter fabrics, to produce fabrics with a higher quality and to do this in a manner that will enable to shift from one texture to another in a more flexible way. A further advantage is that there will be more opportunities for optimization to realize the geometry of the shed by means of the shed forming devices. Moreover, in this manner, the cost price of the device can be reduced and the device will be kept compact.

In a first preferred embodiment of a device according to the invention, the first shed forming devices for actuating the tension warp yarns are consisting of cam disc machines.

In a first more preferred embodiment of a device according to the invention, the second shed forming devices for actuating the binding warp yarns are consisting of cam disc machines.

In a second more preferred embodiment of a device according to the invention, the second shed forming devices for actuating the binding warp yarns are consisting of electronic dobby devices.

In a third more preferred embodiment of a device according to the invention, the second shed forming devices for actuating the binding warp yarns are consisting of one or several weaving frames which are controlled by one or several motor drives.

In a fourth more preferred embodiment of a device according to the invention, the second shed forming devices for actuating the binding warp yarns are consisting of Jacquard devices.

In a second preferred embodiment of a device according to the invention, the first shed forming devices for actuating the tension warp yarns are consisting of electronic dobby devices.

In a first more preferred embodiment of a device according to the invention, the second shed forming devices for actuating the binding warp yarns are consisting of cam disc machines.

In a second more preferred embodiment of a device according to the invention, the second shed forming devices for actuating the binding warp yarns are consisting of electronic dobby devices.

In a third more preferred embodiment of a device according to the invention, the second shed forming devices for actuating the binding warp yarns are consisting of one or several weaving frames which are controlled by one or several motor drives.

In a fourth more preferred embodiment of a device according to the invention, the second shed forming devices for actuating the binding warp yarns are consisting of Jacquard devices.

In a third preferred embodiment of a device according to the invention, the first shed forming devices for actuating the tension warp yarns are consisting of one or several weaving frames which are controlled by one or several motor drives.

In a first more preferred embodiment of a device according to the invention, the second shed forming devices for actuating the binding warp yarns are consisting of cam disc machines.

In a second more preferred embodiment of a device according to the invention, the second shed forming devices for actuating the binding warp yarns are consisting of electronic dobby devices.

In a third more preferred embodiment of a device according to the invention, the second shed forming devices for actuating the binding warp yarns are consisting of Jacquard devices.

In a fourth preferred embodiment of a device according to the invention, the first shed forming devices for actuating the tension warp yarns are consisting of Jacquard devices.

In a first more preferred embodiment of a device according to the invention, the second shed forming devices for actuating the binding warp yarns are consisting of cam disc machines.

In a second more preferred embodiment of a device according to the invention, the second shed forming devices for actuating the binding warp yarns are consisting of electronic dobby devices.

In a third more preferred embodiment of a device according to the invention, the second shed forming devices for actuating the binding warp yarns are consisting of one or several weaving frames, which are controlled by one or several motor drives.

In a fourth more preferred embodiment of a device according to the invention, the second shed forming devices for actuating the binding warp yarns are consisting of Jacquard devices.

When in a device according to the invention, one or several Jacquard devices are used, on the one hand these Jacquard devices used for actuating the motion of backing warp yarns may be provided with a harness which is carried out with a repeat factor.

On the other hand, the one or several Jacquard devices used for actuating the motion of the backing warp yarns may be provided with a harness which is carried out as an open harness.

In a preferred embodiment of a device according to the invention, the first, respectively the second shed forming devices respectively are driven from the right hand side of the weaving machine, while the second, respectively the first shed forming devices respectively are driven from the left hand side of the weaving machine.

When both the first and the second shed forming devices are electronic dobby devices or cam disc machines, a weaving frame may be driven alternately by one of the first, respectively the second shed forming devices, after which a weaving frame will be driven by one of the second, respectively the first shed forming devices.

On the other hand, the purpose of the invention is attained by providing a pile weaving machine, which is provided with a device according to the invention.

Preferably, the pile weaving machine is a face-to-face weaving machine.

In order to further clarify the properties of the present invention and to indicate its additional advantages and particulars, a detailed description of the various embodiments of a device according to the invention will now follow. It may be obvious that nothing in the following description may be interpreted as being a restriction of the protection of the method and the device according to the invention, demanded for in the claims.

Furthermore, a few of these embodiments will be discussed in the attached figures, in which, by means of reference numbers, will be referred to these figures, in which:

DETAILED DESCRIPTION OF THE PREFERRED EMBODIMENTS

Figure 1:
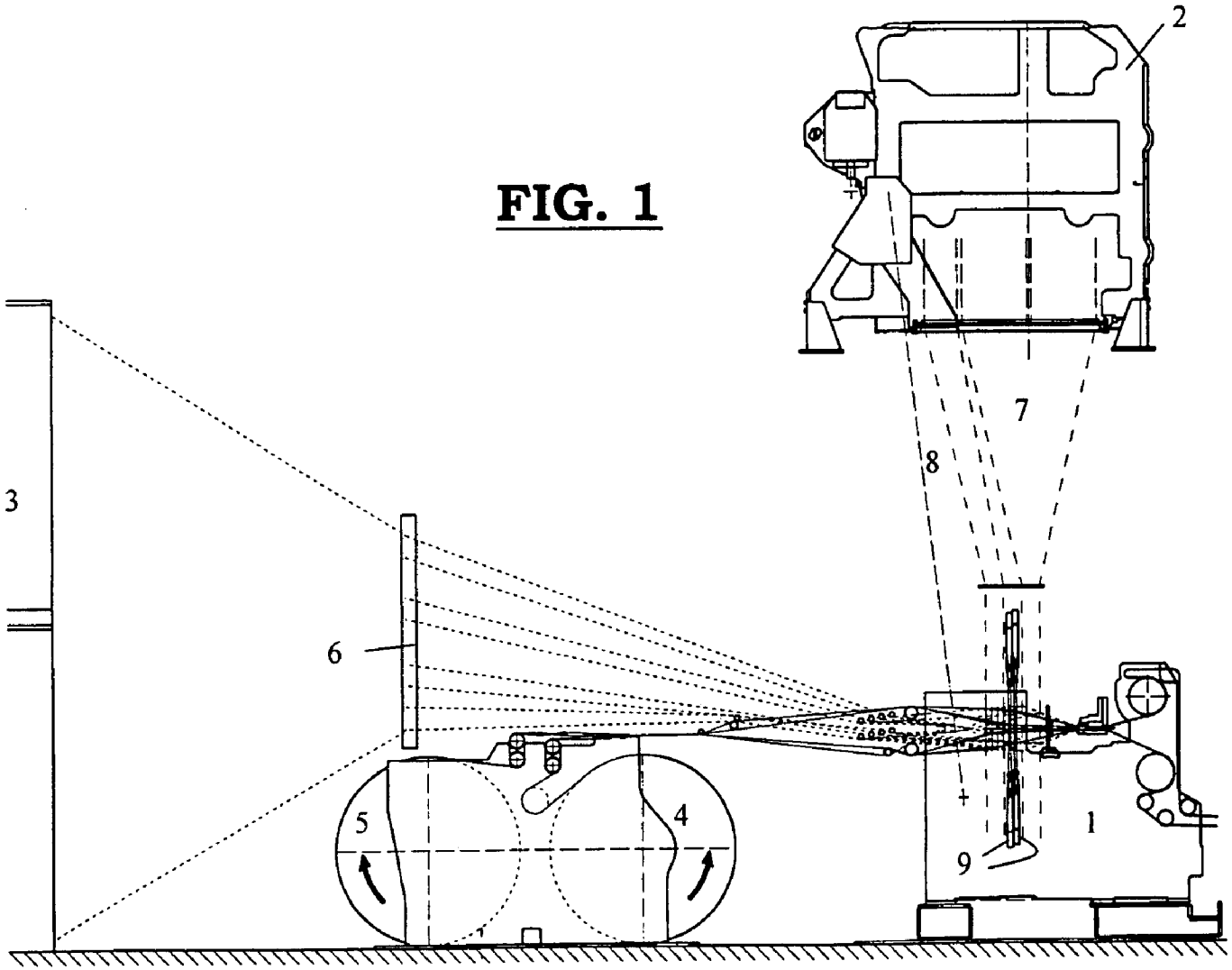
FIG. 1 is representing a schematic side view of a face-to-face weaving machine with a supply of pile and backing warp yarns, the pile warp yarns being supplied from a weaving creel and a part of a Jacquard machine being provided to carry binding warp yarns into the required position in the shed forming in order to realize a pattern requested.

In a device for actuating binding and tension warp yarns according to the invention, at least one first shed forming device is provided for actuating the tension warp yarns and at least one second shed forming device is provided for actuating the binding warp yarns. The first or the second said shed forming devices being provided with a central drive for actuating the respective yarns. In all the embodiments of a device according to the invention described hereafter, the first, respectively the second shed forming device are preferably driven from the right-hand side of the weaving machine, whereas the second, respectively first shed forming device are driven from the left-hand side of the weaving machine. When both first and second shed forming devices are electronic dobby devices or cam disc machines, a further preferred solution may consist in a weaving frame which is driven alternately with one of the first, respectively second shed forming devices and then a weaving frame is driven by the second, respectively the first shed forming devices.

By separating the shed forming devices of the tension and the binding warp yarns, it is possible to switch over, for one type of backing warp yarn, for instance, to another shed forming device, so that in the first shed forming device constructively more possibilities will become available for driving more weaving frames, for instance, for the other type of backing warp yarn. In this manner a greater variability of textures may be obtained.

When, for instance, there are six weaving frames in a known cam disc machine, 4 of which have been provided for the binding warp yarns and two for the tension warp yarns, this will mean that when switching over, for the backing warp yarns, from one type, i.e. the tension warp yarns or the binding warp yarns respectively, to another type of shed forming device, for instance, a weaving frame which is controlled by a motor drive, all six driving levers will become available for the backing warp yarns of the other type, i.e. the binding warp yarns or the tension warp yarns respectively. In this manner, it will be possible to realize a greater variety of textures, and in many cases, the choice of the shed forming device being shifted over to, may in turn provide an additional variability of textures.

In the same way, the tension warp yarns may stay on the cam disc machines, whereas the binding warp yarns are installed on a 2-position Jacquard machine for double rapier weaving or installed on a 3-position Jacquard machine for three rapier weaving. In this manner, room can be made for a driving device through four or six weaving frames for the tension warp yarns. For the binding warp yarns a very large variability may be realized by operating in an open harness. When using an open harness, each yarn is connected to a hook and it will be possible for each hook to be selected separately all along the width of the fabric. Therefore, each warp yarn can be actuated individually in each yarn system. With tighter fabrics this will require a Jacquard machine with a large number of hooks. In order to reduce the cost and yet to be able to maintain a significantly larger variability of textures than with devices in accordance with the state-of-the-art it will be possible to work, as is a common way of working with flat weaving, with a Jacquard machine which is provided with a harness which is provided with a repeat factor, such as, for instance 2, 4, 6, 8, 10 etc. Because of which the number of hooks in the Jacquard machine will be divided by the repeat factor, which will strongly reduce the cost of the Jacquard machine, but at the same a significantly larger variability of textures will be maintained than with a device in which 4 or even 10 weaving frames are used for the binding warp yarns.

For a fabric having a reed density of 500 dents per metre along a weaving width of 4 m with 4 binding warp yarns per reed dent, for instance there are 8000 binding warp yarns. When provided with an open harness, these 8000 binding warp yarns may be individually actuated, which is corresponding to a possibility of an almost infinite variability with respect to the 4 or even 10 weaving frames available. When a harness is used which is provided with a repeat factor of 10, for instance, the number of binding warp yarns to be actuated separately will be reduced to 800. A Jacquard machine having only 800 selection elements is a compact and cost-effective Jacquard machine, so that the restricted increase of the cost will be largely justified by the strong increase as variability of textures is concerned. Since the variability of this solution is equivalent to the design having 800 weaving frames for the binding warp yarns.

In the same way, independently of the binding warp yarns, which will stay, for instance, on the cam disc machines and therefore will get even more weaving frame drives at their disposal, the tension warp yarns may be connected to a 2-position Jacquard machine, which, with or without a repeat factor, is positioning these tension warp yarns. For pile fabrics comprising areas in which the backing fabric is made visible, this will offer the opportunity to make the weft yarns visible, which may have varying colours, for instance, in order to form a particular pattern or logo.

In the embodiments of a device according to the invention described above, in which the tension warp yarns or the binding warp yarns are actuated from one or several Jacquard devices, also the weaving frames actuating the binding or tension warp yarns, may be controlled separately by means of one or several motor drives in stead of driving them as a package by means of one or several cam disc machines. By using a more restricted number of motors, the disadvantage of the cost will be strongly reduced and the flexibility will further increase.

In the preferred embodiments of a device according to the invention described above, where one or several cam disc machines are used for driving the binding or tension warp yarns, it is also possible to use an electronic dobby device, offering the same advantages as the embodiments with the cam disc machines.

In a further preferred embodiment, both tension warp yarns and binding warp yarns each are installed on a separate Jacquard machine, the device being made cost-effective, as, in case a harness is used which is provided with a repeat factor, the Jacquard devices may be kept rather small, whereas they are capable of allowing a very large variability of textures, as already described above.

Departing from a cam disc machine, driving 6 or 8 weaving frames for binding and tension warp yarns together, the binding warp yarns may also be transferred to an electronic dobby device, whereas the tension warp yarns are kept on a reduced cam disc machine, which means, for instance, 2 or 4 weaving frames for driving the tension warp yarns. This being the case, the drive of the cam disc machine may take place from one side of the weaving machine, whereas the drive of the dobby device occurs from the other side of the weaving machine. This splitting up, will in turn increase the variability of textures which may be realized.

On a three rapier weaving machine the binding warp yarns have to be positioned in three positions. Here, it may be advisable that the binding warp yarns in the two lower positions will conduct a rapier in its path to the co-acting rapier, whereas it may be desirable for the binding warp yarns to be situated in the upper position. The solution here is an asymmetric shed, which may be realized by means of a cam disc machine, which, however, is not adjustable and this without replacing any cams. On a dobby device this asymmetry is indeed adjustable, since a dobby device is operating in conjunction with two levers in order to attain three positions. By adjusting both levers in a different manner, a modified asymmetric shed may be obtained.

Furthermore it should be noted that, as far as the said asymmetry is concerned, in the shed forming by the binding warp yarns on a three rapier weaving machine, it will be still more advantageous to adjust the asymmetry in the shed for the upper and the lower fabric in a different manner. To that effect, either two different dobby devices should be used for the binding warp yarns, or the binding warp yarns should be positioned in he shed through weaving frames which are controlled by a motor drive.

When on a three rapier weaving machine, the binding warp yarns are actuated by a dobby device, and the more heavily strained tension warp yarns will stay on a cam disc machine, the asymmetric shed on the dobby device will become adjustable without having to exchange any cams, as is the case with the combination with the cam disc machine for the binding warp yarns. Since the tension and binding warp yarns are operating under a different strain, the dimension figures of the device for the binding warp yarns may proof themselves to be more compact than the ones used for the device for the tension warp yarns, or, in other words, more weaving frames may be accommodated and driven in the same volume. By limiting the separated shed forming device for the tension warp yarns to 2 or 4 weaving frames, in turn, it will be possible to make this construction more compact. Separating the shed forming devices in one or several cam disc machines for the tension warp yarns, submitted to a greater strain, and one or several dobby devices for the binding warp yarns therefore is an advantageous optimization as a preferred embodiment of a device according to the invention. The other way round is likewise possible, the tension warp yarns being actuated by one or several electronic dobby devices, whereas the binding warp yarns being actuated by one or several cam disc machines. Hereby, the variability of textures is likewise increased in the same way.

Another possible optimization which may be realized is, by actuating both types of backing warp yarns each, either by means of one or several separate cam disc machines, or by means of one or several separate dobby devices. As already mentioned above, preferably one device is driven from the left-hand side of the weaving machine, whereas the other device is driven from the right-hand side of the weaving machine. A further preferred solution may consist of that a weaving frame is alternatively driven from the left by one of the first, respectively second shed forming devices, and then a weaving frame is driven from the right by one of the second, respectively first shed forming devices. This design will enable:

- either to optimize the thickness of a weaving frame and hereby limiting the total package of weaving frames for a fixed number of weaving frames as to depth, whereas the driving sets for the weaving frames, because of their being separated to the right and to the left, will get available the space equal to the thickness of two weaving frames. Owing to this, the depth of a package of weaving frames may almost be halved. This solution also enables more weaving frames to be installed in the same depth.
- either by maintaining the depth of the package of weaving frames, to reinforce the driving sets, so that weaving will be possible, while the warp yarns may be submitted to a greater strain.

In the various embodiments described above, the motions of the various first and second shed forming devices may be mutually shifted with respect to the time axis. With motor controlled drives of one of those shed forming devices this shifting along the time axis may also be performed in a flexible manner. For cam disc machines, electronic dobby devices and Jacquard devices the central driving shaft to perform this motion should be controlled by a motorized actuator, or a modification of this motion may be imposed by means of a stepping motor or a servomotor in superposition on a mechanical clutch.

Such a device according to the invention may be applied to any pile weaving machine, both single-piece and face-to-face weaving machines.

In the following description a few of the embodiments mentioned above are further described with reference to the figures.

Figure 2:
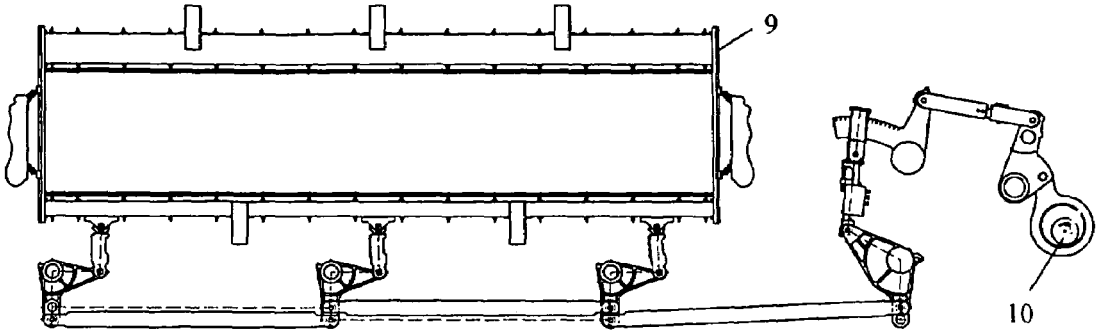
FIG. 2 is representing a schematic front view of a weaving frame for a tension warp yarn according to an embodiment of the device which is compatible with FIG. 1, the weaving frame for the tension warp yarns being driven by a motor drive by means of intermediate levers and rods.
Figure 3:
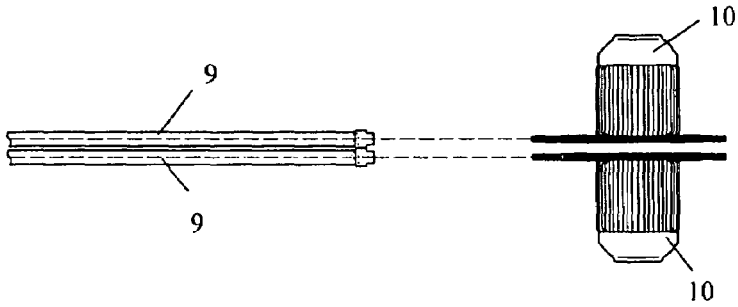
FIG. 3 is representing a schematic top view of two weaving frames for tension warp yarns according to FIG. 2, two motor drives being provided, i.e. one for each weaving frame.

In FIG. 1 a face-to-face weaving machine (1) is represented, the warp yarns, i.e. both pile warp yarns and backing warp yarns (consisting of tension warp yarns and binding warp yarns) being supplied, the pile warp yarns (6) being supplied from a weaving creel (3) and a part (7) of the Jacquard machine (2) bringing the pile warp yarns (6) into the required position in the shed forming in order to realize the pattern required. The backing warp yarns, which together with the wefts, are constituting the backing fabrics, are supplied from the warp beams (4, 5), the tension warp yarns being supplied to the weaving machine (1) from a first warp beam (4) and the binding warp yarns being supplied from a second warp beam (5). In order to be able to take up their positions in the shed, the tension warp yarns are actuated by two weaving frames (9), one of which is actuating the tension warp yarns of the upper fabric and a second weaving frame is actuating the tension warp yarns for the lower fabric. The binding warp yarns being supplied from the second warp beam (5) are actuated by a second part (8) of the Jacquard machine (2) before taking up their position in the shed. It is also possible to drive the pile warp yarns (6) and the binding warp yarns by two separate Jacquard devices (2). In FIG. 2, a weaving frame (9) for a tension warp yarn is represented in accordance with an embodiment that is compatible with FIG. 1. The weaving frame (9) is therewith driven by a motor (10) by means of intermediate levers and rods. In FIG. 3, the two weaving frames (9) for the tension warp yarns of FIG. 2 are represented, two motors (10) being provided, i.e. one motor (10) for each weaving frame (9).

Figure 4:
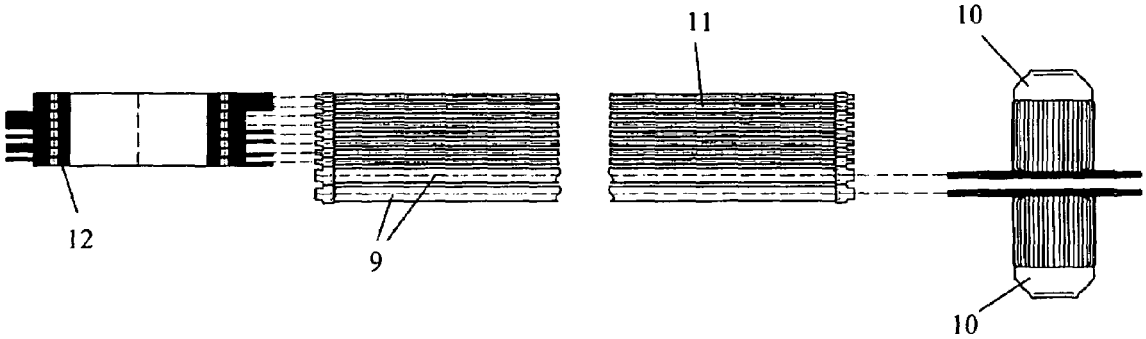
FIG. 4 is representing a schematic top view of the drives for the backing warp yarns in a face-to-face weaving machine, the tension warp yarns being brought into their positions in the shed by means of two weaving frames, each driven by a servomotor, and binding warp yarns being brought into their positions in the shed by 4 weaving frames, which are actuated by a cam disc machine.
Figure 5A:
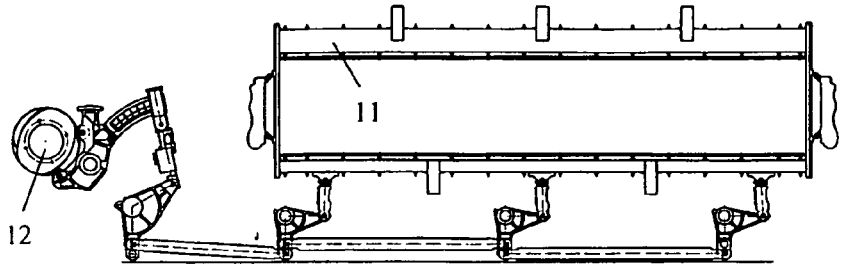
FIG. 5*a* is representing a schematic representation of the drive of a weaving frame for the binding warp yarns by means of a cam disc machine.
Figure 5B:
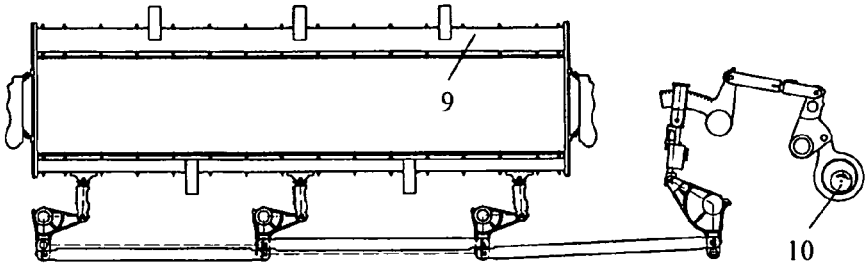
FIG. 5*b* is representing a schematic representation of the drive of a weaving frame for the tension warp yarns by means of a motor drive.

In FIG. 4, the driving devices for the backing warp yarns in a face-to-face weaving machine (1) are represented, the tension warp yarns being brought into their positions in the shed by two weaving frames (9), each driven by a servomotor and the binding warp yarns being brought into their positions by four weaving frames (11) which are actuated by a cam disc machine (12). In FIG. 5*a*, a drive by means of a cam disc machine of a weaving frame (11) for the binding warp yarns of FIG. 4 is represented. In FIG. 5*b* a drive by means of a motorized actuator (10) of a weaving frame (9) for the tension warp yarns of FIG. 4 is represented.

Figure 6:
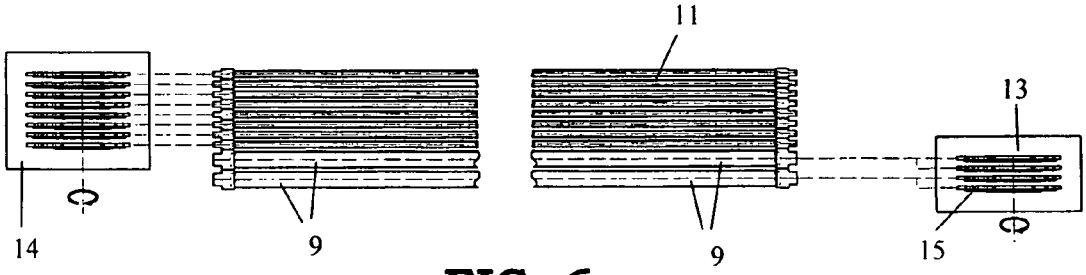
FIG. 6 is representing a schematic representation of a device according to the invention, in which 2 weaving frames for the tension warp yarns are driven by a first electronic dobby device, and 8 weaving frames for the binding warp yarns are driven by a second electronic dobby device, the dobby devices being installed on different sides of the weaving machine, and the weaving frames for the tension warp yarns being driven by a double rotor.
Figure 7:
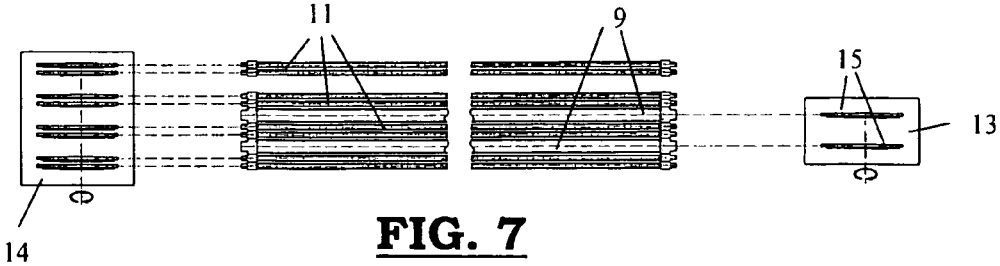
FIG. 7 is representing a schematic representation of a device according to the invention, in which 2 weaving frames for the tension warp yarns are driven by a first electronic dobby device, and 8 weaving frames for the binding warp yarns are driven by a second electronic dobby device, the dobby devices being installed on different sides of the weaving machine, and the weaving frames for the tension and the binding warp yarns are alternating.

In the FIGS. 6 and 7, devices are represented in which two weaving frames (9) for the tension warp yarns are driven by a first electronic dobby device (13), and 8 weaving frames (11) for the binding warp yarns are driven by a second electronic dobby device (14). The dobby devices (13) are installed on different sides of the weaving machine (1). However, they may also be installed on the same side of the weaving machine (1). In FIG. 6, the weaving frames (9) for the tension warp yarns are driven by a double rotor (15), because of which they may operate at a higher load because of the tension warp yarns. In FIG. 7, the weaving frames for the tension warp yarns and the backing warp yarns are alternating, so that each rotor will get more installing space and may be of a stronger design, or where each weaving frame may be driven by a double rotor situated next to one another. This may prevent the rotors, in case double rotors are required, from the necessity of installing the rotors one on top of the other. Another opportunity of this embodiment is consisting in that the thicknesses of the weaving frames will be reduced, whereas the thicknesses of the rotors will remain unchanged. Thus, a more compact package of weaving frames will be obtained, while the strength of the rotors will be maintained.

Figure 8A:
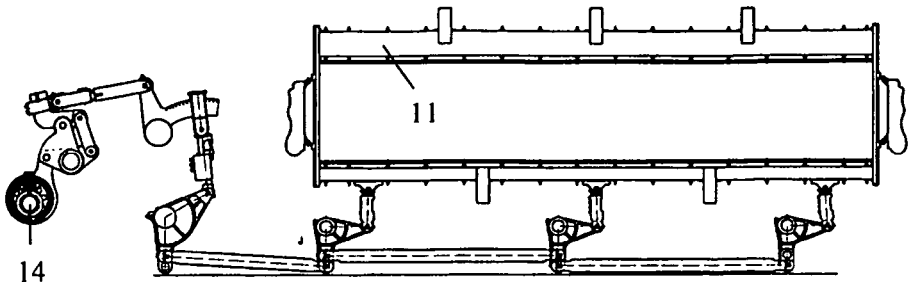
FIG. 8*a* is representing a schematic front view of a weaving frame for the tension warp yarns, the weaving frame being driven by a dobby device by means of intermediate levers and rods.

In FIG. 8*a* a weaving frame (11) is represented for binding warp yarns, the weaving frame (11) being driven by a dobby device by means of intermediate levers and rods. Herewith, the lever is able to take up three positions.

Figure 8B:
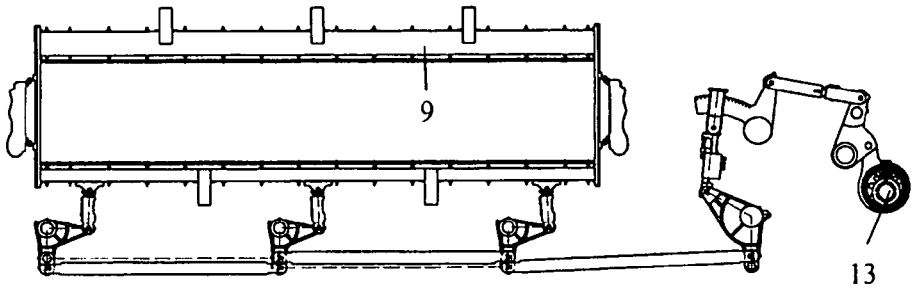
FIG. 8*b* is representing a schematic front view of a weaving frame for the binding warp yarns, the weaving frame being driven by a dobby device by means of intermediate levers and rods.

In FIG. 8*b*, a weaving frame (9) is represented for tension warp yarns, the weaving frame (9) being driven by a dobby device by means of intermediate levers and rods.

The invention claimed is:

1. Device for actuating binding and tension warp yarns, comprising at least one first shed forming device and at least one second shed forming device, wherein the first shed forming device actuates the tension warp yarns and the second shed forming device actuates the binding warp yarns, the first shed forming device or the second shed forming device comprising a central drive, wherein the at least one first shed forming device comprises its own central drive for actuating the tension warp yarns separately from the binding warp yarns or wherein the at least one second shed forming device comprises its own central drive for actuating the binding warp yarns separately from the tension warp yarns.

2. Device according to claim 1, characterized in that the first shed forming devices for actuating the tension warp yarns are consisting of cam disc machines.

3. Device according to claim 2, characterized in that the second shed forming devices for actuating the binding warp yarns are consisting of cam disc machines.

4. Device according to claim 2, characterized in that the second shed forming devices for actuating the binding warp yarns are consisting of electronic dobby devices.

5. Device according to claim 2, characterized in that the second shed forming devices for actuating the binding warp yarns are consisting of one or several weaving frames which are controlled by one or several motor drives.

6. Device according to claim 2, characterized in that the second shed forming devices for actuating the binding warp yarns are consisting of Jacquard devices.

7. Device according to claim 1, characterized in that the first shed forming devices for actuating the tension warp yarns are consisting of electronic dobby devices.

8. Device according to claim 7, characterized in that the second shed forming devices for actuating the binding warp yarns are consisting of cam disc machines.

9. Device according to claim 7, characterized in that the second shed forming devices for actuating the binding warp yarns are consisting of electronic dobby devices.

10. Device according to claim 7, characterized in that the second shed forming devices for actuating the binding warp yarns are consisting of one or several weaving frames which are controlled by one or several motor drives.

11. Device according to claim 7, characterized in that the second shed forming devices for actuating the binding warp yarns are consisting of Jacquard devices.

12. Device according to claim 1, characterized in that the first shed forming devices for actuating the tension warp yarns are consisting of one or several weaving frames which are controlled by one or several motor drives.

13. Device according to claim 12, characterized in that the second shed forming devices for actuating the binding warp yarns are consisting of cam disc machines.

14. Device according to claim 12, characterized in that the second shed forming devices for actuating the binding warp yarns are consisting of electronic dobby devices.

15. Device according to claim 12, characterized in that the second shed forming devices for actuating the binding warp yarns are consisting of Jacquard devices.

16. Device according to claim 1, characterized in that the first shed forming devices for actuating the tension warp yarns are consisting of Jacquard devices.

17. Device according to claim 16, characterized in that the second shed forming devices for actuating the binding warp yarns are consisting of cam disc machines.

18. Device according to claim 16, characterized in that the second shed forming devices for actuating the binding warp yarns are consisting of electronic dobby devices.

19. Device according to claim 16, characterized in that the second shed forming devices for actuating the binding warp yarns are consisting of one or several weaving frames, which are actuated by one or several motor drives.

20. Device according to claim 16, characterized in that the second shed forming devices for actuating the binding warp yarns are consisting of Jacquard devices.

21. Device according to claim 6, characterized in that one or several of the Jacquard devices used for actuating the motion of the backing warp yarns are provided with a harness which is carried out with a repeat factor.

22. Device according to claim 6, characterized in that one or several of the Jacquard devices used for actuating the motion of the backing warp yarns are provided with a harness which is carried out as an open harness.

23. Device according to claim 1, characterized in that the first and second shed forming devices respectively, are driven from the right-hand side of the weaving machine, whereas the second and the first shed forming devices respectively are driven from the left-hand side of the weaving machine.

24. Device according to claim 3, characterized in that a weaving frame is driven alternately by one of the first, respectively second shed forming devices after which a weaving frame is driven by one of the second, respectively first shed forming devices.

25. Pile weaving machine, characterized in that the pile weaving machine is provided with a device according to claim 1.

26. Pile weaving machine according to claim 25, characterized in that the pile weaving machine is a face-to-face weaving machine.

* * * * *